US007404383B2

(12) United States Patent
Elendt

(10) Patent No.: US 7,404,383 B2
(45) Date of Patent: Jul. 29, 2008

(54) VALVE TRAIN WITH CAM SWITCHING FOR THE GAS EXCHANGE VALVES OF A FOUR-CYCLE INTERNAL COMBUSTION ENGINE

(75) Inventor: Harald Elendt, Altendorf (DE)

(73) Assignee: Schaeffler KG, Herzogenaurach (DE)

( * ) Notice: Subject to any disclaimer, the term of this patent is extended or adjusted under 35 U.S.C. 154(b) by 102 days.

(21) Appl. No.: 10/598,128

(22) PCT Filed: Jan. 18, 2005

(86) PCT No.: PCT/EP2005/000416

§ 371 (c)(1),
(2), (4) Date: Aug. 18, 2006

(87) PCT Pub. No.: WO2005/080761

PCT Pub. Date: Sep. 1, 2005

(65) Prior Publication Data

US 2007/0178731 A1 Aug. 2, 2007

(30) Foreign Application Priority Data

Feb. 21, 2004 (DE) ..... 10 2004 008 670

(51) Int. Cl.
*F01L 1/34* (2006.01)

(52) U.S. Cl. ..... 123/90.16; 123/90.18; 123/90.6

(58) Field of Classification Search ..... 123/90.15, 123/90.16, 90.17, 90.18, 90.27, 90.31, 90.6
See application file for complete search history.

(56) References Cited

U.S. PATENT DOCUMENTS 7,036,473 B1 * 5/2006 Goracy ..... 123/90.27

FOREIGN PATENT DOCUMENTS

| | | | |
|---|---|---|---|
| DE | 42 30 877 | A | 4/1993 |
| DE | 196 11 641 | Y | 6/1997 |
| DE | 100 54 623 | Y | 5/2002 |
| DE | 101 48 179 | A | 4/2003 |
| DE | 101 48 243 | A | 4/2003 |
| EP | 0 798 451 | A | 10/1997 |

* cited by examiner

*Primary Examiner*—Ching Chang
(74) *Attorney, Agent, or Firm*—Lucas & Mercanti, LLP

(57) ABSTRACT

A valve train with cam switching used for intermittent control of a four-cycle internal combustion engine. The valve train comprises a splined shaft, one cam block per cylinder, and a housing-mounted actuator pin. On each end of the cam block is a cylindrical end piece and a mirror-symmetric displacing groove. A housing-mounting actuator pin inserts radially into each displacing groove. The cam block reciprocates axially through the cooperation of the actuator pins and the displacing grooves when the engine is running. Low wear of the valve train and a high switching speed are achieved due to the fact that the displacing grooves possess an accelerating flank with an impact ramp that results in a constant, low initial axial speed of the cam block and a feeble impact force of the actuator pins.

6 Claims, 3 Drawing Sheets

VALVE TRAIN WITH CAM SWITCHING FOR THE GAS EXCHANGE VALVES OF A FOUR-CYCLE INTERNAL COMBUSTION ENGINE

FIELD OF THE INVENTION

The invention concerns a valve train comprising cam switching typically for an intermittent control of gas exchange valves of a four-cycle internal combustion engine comprising:

- a splined shaft comprising an axial outer gearing and one cam block per cylinder, said cam block comprising an inner gearing through which the cam block can be axially displaced and connected rotationally fast to the splined shaft;
- the cam block comprising per gas exchange valve two cams arranged adjacent to each other and having identical base circle diameters and unequal lifts;
- on each end of the cam block is arranged a cylindrical end piece, and a mirror-symmetrical displacing groove is made radially in the periphery of each cylindrical end piece;
- a housing-mounted actuator pin for radial insertion into each displacing groove, the cam block being able to reciprocate axially through the cooperation of the actuator pins and the displacing grooves when the engine is running.

BACKGROUND OF THE INVENTION

Efforts to reduce fuel consumption and pollutant emission in modern internal combustion engines should obviously also include the consideration of intermittent or on-off control. With this method, in which individual cylinders are at least temporarily shut off, the mean pressure of the still firing cylinders is raised. This leads to a reduction of the specific fuel consumption. To guarantee that all the cylinders have the operating temperature required for an efficient and low-pollution combustion during intermittent operation, a frequent change-over is necessary between fired and non-fired cylinders.

DE 101 48 179 A1 discloses a valve lift or cam switching arrangement that is suitable for an on-off control of the gas exchange valves of a four-cycle internal combustion engine. This arrangement has the following features and components:

- a splined shaft comprising an axial outer gearing and one cam block per cylinder comprising an inner gearing through which the cam block can be axially displaced and connected rotationally fast to the splined shaft;
- the cam block comprising per gas exchange valve two cams arranged adjacent to each other and having identical base circle diameters and unequal lifts;
- on each end of the cam block is arranged a cylindrical end piece, and a mirror-symmetrical displacing groove is made radially in the periphery of each cylindrical end piece;
- a housing-mounted actuator pin for radial insertion into each displacing groove, the cam block being able to reciprocate axially through the cooperation of the actuator pins and the displacing grooves when the engine is running.

For implementing an on-off control, one full lift cam and one zero lift cam has to be provided for each valve, and these cams are pushed to and fro during change-over between firing and non-firing operation. An intrinsic danger arising from the frequent and rapid switching of the cams is the overloading and wear of the switching mechanism, particularly of the displacing grooves and actuator pins.

Comparable, even if moderated, loading conditions for the displacing grooves and actuator pins are given if the switching-over of the inlet cams of the cam pairs of the cam block serves to realize a two-point camshaft adjuster. To this end, the inlet cams of a cam pair have equal cam lifts but different phases for the range of low and high engine speeds.

In a similar manner, it is possible to conceive a valve train with a fully variable mechanical valve lift adjustment in combination with a cam switching system in which each pair of inlet cams of the cam block comprises one inlet cam that is optimized for low load and speed and one inlet cam that is optimized for high load and speed. In this way, the range of low load and speed can be operated for favorable consumption and the range of high load and speed can be operated for high performance. In both these modes of cam switching, the frequency of switching is low compared to that required in intermittent control.

OBJECTS OF THE INVENTION

It is an object of the invention to provide a valve train of a generic type that distinguishes itself by controllable loading and low wear as also by a high switching speed.

This and other objects and advantages of the invention will become obvious from the following detailed description.

SUMMARY OF THE INVENTION

The invention achieves the above objects by the fact that the displacing grooves possess an accelerating flank comprising an impact ramp whose constant, gentle ascending gradient causes a correspondingly constant, low initial axial speed of the cam block and a feeble impact force of the actuator pins. Through these features, wear of the displacing grooves and actuator pins is avoided for the most part. This enables a high switching speed and a minimization of switching noise.

For avoiding wear and overloading of the impact ramps and actuator pins, it has proved to be advantageous to configure the ascending gradient of the impact ramp in the range of 5 to 50 μm per degree.

Advantageously also, the axial clearance of the actuator pins in the displacing grooves, depending on the tolerances, is, for instance, 1.2 mm in the run-in region, decreases to, for instance, 0.1 mm up to the change-over point between the accelerating flank and a braking flank, and increases up to the run-out region to, for instance, 0.2 mm.

The relatively large axial clearance in the run-in region of the displacing grooves serves to accommodate positional axial tolerances of the cylinder head-mounted actuator pins and the camshaft-mounted displacing grooves.

The small axial clearance between the actuator pins and displacing grooves in the region of the change-over point results in an almost jerk-free contact transition of the actuator pins from the accelerating flank to the braking flank of the displacing grooves. The somewhat larger axial clearance in the run-out region that is free from side forces permits a somewhat coarser finishing of this part of the displacing grooves.

Because the base circle region of the cams extends from the beginning of the impact ramp to the end of the braking region i.e., because it extends in the region of the axial displacing movement of the cam blocks, a step-less transition from cam to cam is possible.

Another advantageous feature is that the displacing grooves on the periphery of the cylindrical end pieces start with a depth run-in region and end with a depth run-out region and that a depth region having a constant depth is situated between these depth run-in and run-out regions.

It is of advantage for the durability of the actuator pins if the depth region begins before the impact region of the accelerating flank and extends up to the end of the braking region. During its loading by the axial displacing force, the actuator pin is thus situated in the depth region of the displacing groove and is loaded over its entire length.

In this way, when loaded by side forces, the actuator pins are situated in the depth region of the displacing grooves, so that the largest possible surface of the actuator pins and displacing grooves is available for supporting the side forces.

Further features of the invention result from the following description and drawings that show a schematic representation of an example of embodiment of the invention.

DETAILED DESCRIPTION OF THE DRAWINGS

The present invention concerns a four-cycle spark ignition internal combustion engine comprising a valve train with cam switching. The valve train comprises a separate inlet and outlet camshaft and two inlet and outlet valves per cylinder.

Figure 1:
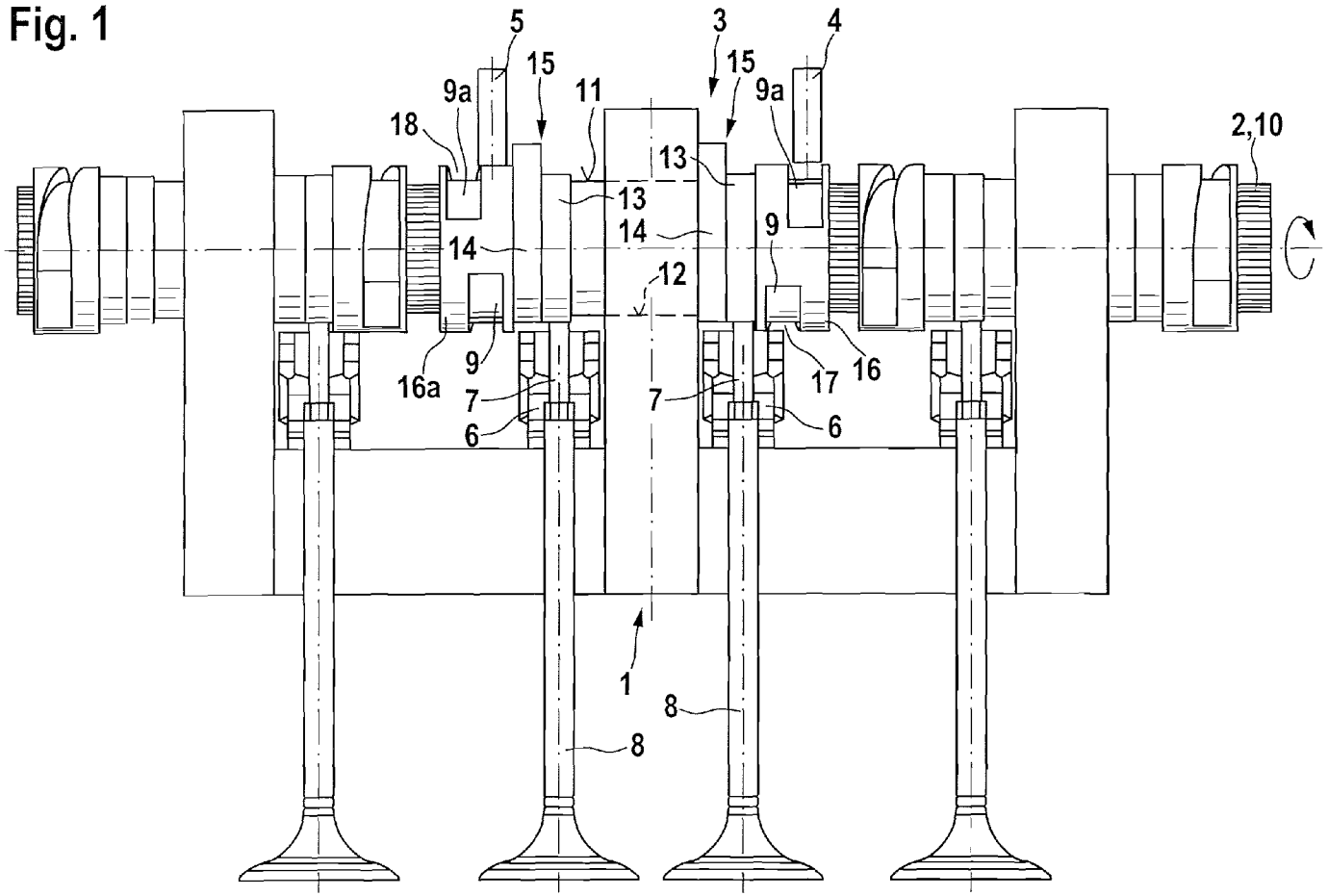
FIG. 1 is a side view of a valve train comprising cam switching for an on-off control.

FIG. 1 shows a cylinder 1 with parts of this valve train. Among these are a splined shaft 2, one cam block 3 per cylinder 1, two actuator pins 4, 5 per cam block 3 and two cam followers 6 with rollers 7 for two gas exchange valves 8. Theses can serve as inlet or as outlet valves.

Along its entire length, the splined shaft has an axial outer gearing 10. Complementary thereto, the cam block 3 comprises an axial inner gearing through which the cam block 3 is connected rotationally fast but axially displaceable to the splined shaft.

On its outer periphery, the cam block 3 comprises a mounting region 11 that serves to support the splined shaft 2. An associated bearing 12 is arranged in the cylinder 1 centrally between the gas exchange valves 8.

The mounting region 11 is flanked by partial or zero lift cams 13 and full lift cams 14, that are arranged as cam pairs 15 immediately next to each other and in the same order. The cams 13 and 14 have equal base circle diameters, so that their axial displacement is possible.

Immediately next to the two cam pairs 15, are arranged cylindrical end pieces 16, 16*a*. Each of the cylindrical end pieces 16 and 16*a* comprises a displacing groove 17 and 18 respectively, that are represented schematically in FIG. 1. The displacing grooves 17, 18 have a helical configuration and are mirror-symmetric to each other, so that each displacing groove 17, 18 has a different displacing direction. The ends of the displacing grooves 17, 18 run out into the periphery of the cylindrical end pieces 16, 16*a*.

The actuator pins 4, 5 are mounted on the cylinder head and can be moved radially towards the axis of the splined shaft. Through an alternating introduction of the actuator pins 4, 5 into the displacing grooves 17, 18 during engine operation, the cams 13, 14 experience an axial displacement corresponding to the width of the cam. The actuator pins 4, 5 are introduced through a depth run-in region 9 into the displacing grooves 17, 18 and transported back through a depth run-out region 9*a* into their initial position and locked. The cam block 3 is locked in its respective end position.

The cams 13, 14 actuate the gas exchange valves 8 through rollers 7 of the cam followers 6. These cam followers 6 are configured as finger or oscillating levers, but it is also conceivable to use rocker arms or cup tappets.

Figure 2:
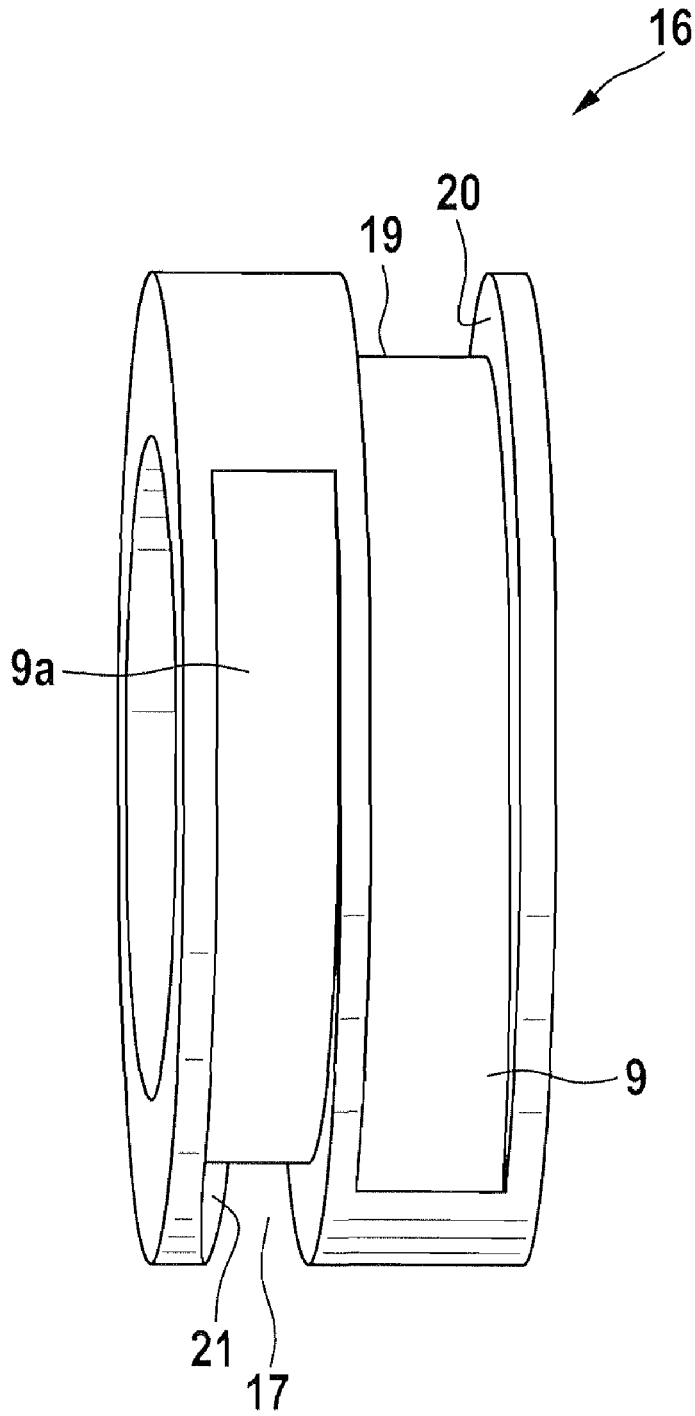
FIG. 2 shows a cylindrical end piece comprising a displacing groove of the invention.
Figure 3:
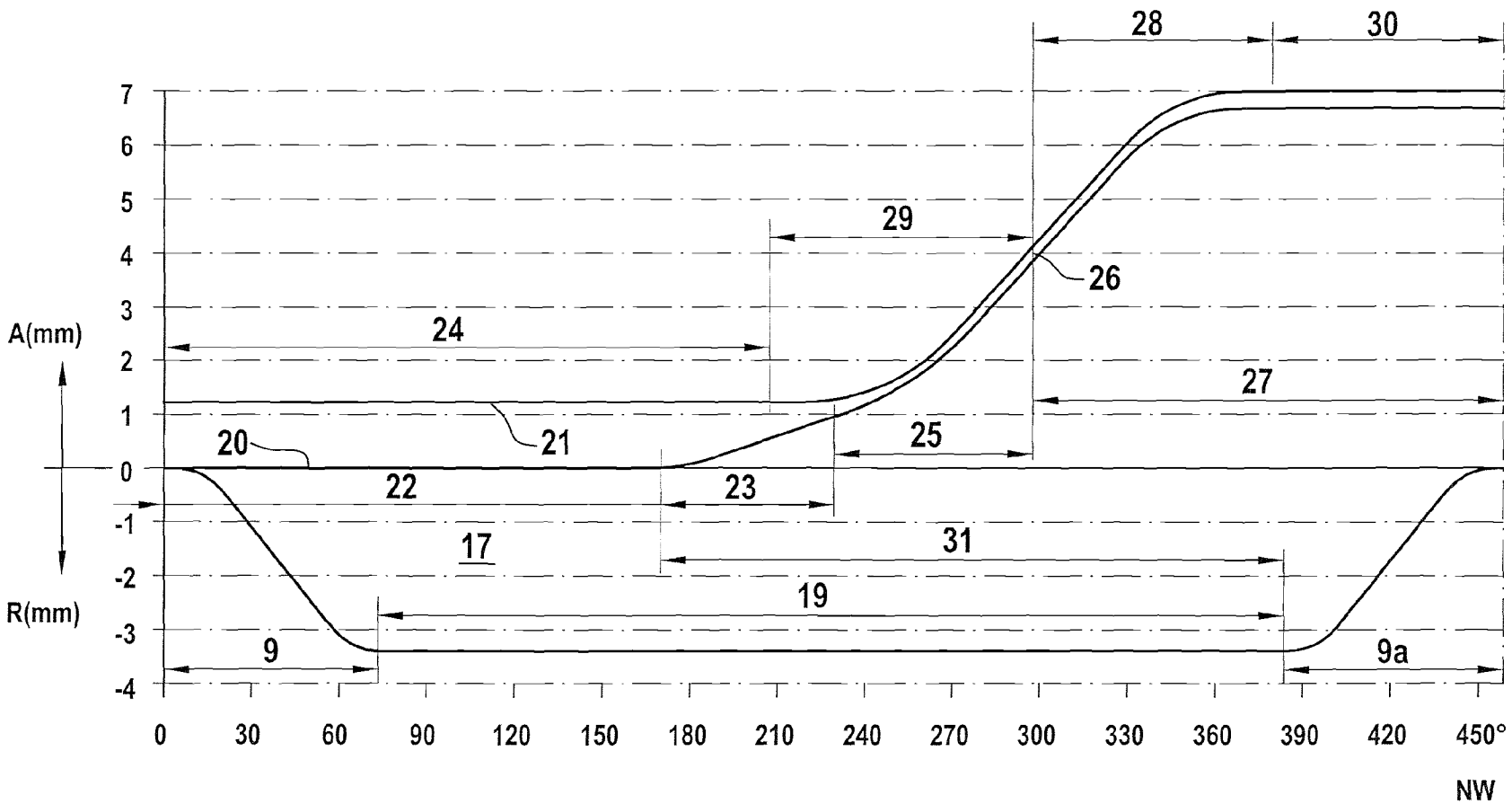
FIG. 3 is a developed view of an accelerating and a braking flank of the displacing groove of FIG. 2, in a top view and in a longitudinal section.

Details of the inventive configuration of the displacing grooves 17, 18 are disclosed in FIGS. 2 and 3.

FIG. 2 shows the cylindrical end piece 16 comprising a displacing groove 17 configured according to the invention. Clearly perceptible is a depth region 19 that is situated between the depth run-in region 9 and the depth run-out region 9*a*. The lateral limitation of the displacing groove 17 is provided by an accelerating flank 20 and a braking flank 21.

FIG. 3 shows developments of a top view of the accelerating and braking flanks 20, 21 and of a longitudinal section of the displacing groove 17. These developments are identical in the case of the displacing groove 18.

The distance between the accelerating flank 20 and the braking flank 21 is the axial clearance of the actuator pin 4 or 5, not shown, in the displacing groove 17 or 18 and depends on the angular position of the cam block 3.

The accelerating flank 20 begins with a run-in region 22 in which the actuator pin 4 passes through the depth run-in region 9 to plunge into the displacing groove 17. The run-in region 22 ends in an impact ramp 23. With an ascending gradient of 5 to 50 μm per degree, this ramp 23 is configured relatively flat so as to keep the impact shock and thus also the wear of the actuator pin 4 and the impact ramp 23 at a low level and the switching speed of the cam block 3 as high as possible.

Parallel to the run-in region 22 of the accelerating flank 20 extends the free-wheeling region 24 of the braking flank 21 with an axial clearance of 1.2 mm. This relatively large axial clearance for the actuator pin 4 assures its reliable plunging into the displacing groove 17 taking into account the axial positional tolerances of the cylinder head-mounted actuator pin 4 and the camshaft-mounted displacing groove 17. These axial positional tolerances are accommodated in the region of the impact ramp 23. The axial clearance of he actuator pin 4 decreases in the region of the linear impact ramp 23 whereas the axial speed of the actuator pin 4 remains constant in this region.

In the accelerating region 25, the axial speed of the cam block 3 increases till a change-over point 26 is reached. At this point, a transition of contact takes place from the accelerating flank 20 to the braking flank 21. Because the axial clearance of the actuator pin 4 in the free-wheeling region 24 of the braking flank 21 decreases to only 0.1 mm till the change-over point 26 is reached, contact transition is practically free of jerks.

From there on, the free-wheeling region 27 of the accelerating flank 20 and the braking region 28 of the braking flank 21 begins. The latter ends in the run-out region 30. In the run-out region 30, the axial clearance of the actuator pin 4 again reaches a value of 0.2 mm with which the actuator pin 4 emerges from the displacing groove 17.

The lower part of FIG. 3 shows a developed view of the displacing groove 17. The depth run-in region 9 opens into the depth region 19 that has a constant depth and is followed by the depth run-out region 9*a*. The plunging of the actuator pin 4 into the displacing groove 17 takes place in the run-in region 22 of the accelerating flank 20 and in the free-wheeling region 24 of the braking flank 21 whereas emerging takes place in the free-wheeling region 27 of the accelerating flank 20 and the free-wheeling region 30 of the braking flank 21.

The base circle region 31 that is of import for the displacement of the cams starts at the beginning of the impact ramp 23 and ends with the end of the braking region 28 of the braking flank 21 i.e., at the beginning of the depth run-out region 9*a* of the displacing groove 17.

The mode of functioning of the valve train of the invention is as follows:

In FIG. 1, the partial or zero lift cams 13 are activated. In this starting position, the gas exchange valves 8 open only slightly or remain completely closed, so that, in the latter case, the cylinder 1 concerned cannot fire. The cam block 3 is locked in its left-hand position and both actuator pins 4, 5 are situated outside of the displacing grooves 17, 18.

In FIG. 1, the direction of rotation of the splined shaft 2, when viewed from the right, corresponds to the clockwise direction. By the insertion of the actuator pin 5 into the displacing groove 18 and a rotation of the splined shaft 2 in the angular range from 180 to 3600 camshaft angle of the common base circle region 31, the cam block 3 is displaced towards the right by one cam width and then locked. This results in an activation of the full lift cams 14, so that gas exchange functions and the cylinder 1 can fire.

After the actuator pin 5 has passed through the depth profile of the displacing groove 18, it exits through the depth run-out region 9*a* at the end of the rotation of the splined shaft.

By an insertion of the actuator pin 4 into the displacing groove 17, the cam block 3 can be re-displaced towards the left into the starting position, so that the partial or zero lift cams are again activated.

Due to the inventive configuration of the displacing grooves 17, 18 with the relatively flat impact ramp 23 of the accelerating flank 20, the actuator pins 4, 5 penetrate gently into the displacing grooves 17, 18 despite the relatively large axial clearance existing in the free-wheeling region 24. Owing to the feeble axial clearance at the change-over point 26, the transition of contact from the accelerating flank 20 to the braking flank 21 takes place practically without jerks, so that wear of the displacing grooves 17, 18 and actuator pins 4, 5 is avoided for the most part even at high switching speeds.

The invention claimed is:

1. A valve train comprising cam switching for an intermittent control of a four-cycle internal combustion engine comprising following features and components:

a splined shaft comprising an axial outer gearing and one cam block per cylinder, said cam block comprising an inner gearing through which the cam block can be axially displaced and connected rotationally fast to the splined shaft;

the cam block comprising per gas exchange valve two cams arranged adjacent to each other and having identical base circle diameters and unequal lifts;

on each end of the cam block is arranged a cylindrical end piece, and a mirror-symmetrical displacing groove is made radially in the periphery of each cylindrical end piece;

a housing-mounted actuator pin for radial insertion into each displacing groove, the cam block being able to reciprocate axially through a cooperation of the actuator pins and the displacing grooves when the engine is running, wherein the displacing groove possesses an accelerating flank comprising an impact ramp whose constant, gentle ascending gradient causes a correspondingly constant, low initial axial speed of the cam block and a feeble impact force of the actuator pins.

2. A valve train of claim 1, wherein the ascending gradient of the impact ramp is situated between 5 and 50 μm per degree.

3. A valve train of claim 2, wherein an axial clearance of the actuator pins in the displacing grooves is 1.2 mm in a run-in region, decreases to 0.1 mm up to a change-over point between the accelerating flank and a braking flank, and increases up to a run-out region to, 0.2 mm.

4. A valve train of claim 3, wherein a base circle region of the cams extends from a beginning of the impact ramp to an end of a braking region.

5. A valve train of claim 4, wherein the displacing grooves on the periphery of the cylindrical end pieces start with a depth run-in region and end with a depth run-out region and that a depth region having a constant depth is situated between said depth run-in and run-out regions.

6. A valve train of claim 5, wherein the depth region begins before an impact region of the accelerating flank and extends up to the end of the braking region.

* * * * *